US005148917A

United States Patent [19]

LeBrun

[11] Patent Number: 5,148,917

[45] Date of Patent: Sep. 22, 1992

[54] MULTIPLE TOOL ORGANIZING AND STORING CARRIER

[76] Inventor: Martin R. LeBrun, 1609 McKenny St., Gillette, Wyo. 82716

[21] Appl. No.: 825,065

[22] Filed: Jan. 24, 1992

[51] Int. Cl.[5] ..... B65D 85/20

[52] U.S. Cl. ..... 206/372; 206/373; 312/902

[58] Field of Search ..... 206/372-379, 206/315.11; 312/DIG. 33

[56] References Cited

U.S. PATENT DOCUMENTS

| | | | |
|---|---|---|---|
| 1,667,938 | 5/1928 | Labadie et al. | 206/373 |
| 1,914,276 | 6/1933 | Moore | 206/373 |
| 2,251,753 | 8/1941 | Newton | 312/DIG. 23 |
| 2,611,479 | 9/1952 | Oliver | 206/373 |
| 3,259,230 | 7/1966 | Jaeger | 206/373 |
| 4,058,210 | 11/1977 | Mitchell | 206/372 |
| 4,294,348 | 10/1981 | Hastings | 312/DIG. 33 |
| 4,303,158 | 12/1981 | Perkins | 312/DIG. 33 |
| 4,366,998 | 1/1983 | Kaiser | 312/DIG. 33 |
| 4,613,041 | 9/1986 | Carlton | 206/373 |
| 4,775,199 | 10/1988 | Lanius et al. | 312/220 |
| 4,819,800 | 4/1989 | Wilson | 206/373 |
| 4,874,199 | 10/1989 | Winter | 224/202 |
| 4,927,021 | 5/1990 | Taylor | 206/373 |

FOREIGN PATENT DOCUMENTS

| | | | |
|---|---|---|---|
| 2004478 | 8/1971 | Fed. Rep. of Germany | 206/372 |
| 0764061 | 12/1956 | United Kingdom | 312/DIG. 33 |

*Primary Examiner*—Jimmy G. Foster
*Attorney, Agent, or Firm*—John R. Flanagan

[57] ABSTRACT

A multiple tool organizing and storing carrier includes a central housing, a pair of opposite side doors, a lid and a plurality of tool holders. The central housing has a bottom wall and upright opposite end walls and an upright partition extending between the opposite end walls. The side doors are pivotally mounted along lower edges thereof to opposite edges of the bottom wall of the central housing. The side doors are pivotable between opened positions away from the central housing and closed positions engaged with opposite side edges of the end walls of the central housing. The lid is hinged to an upper edge of one of the side doors and is pivotally movable for opening away from and closing upon an open top formed by the end walls of the central housing and the side doors when in their closed positions. The tool holders are separately supported on opposite sides of the partition and on the interiors of the side doors.

17 Claims, 3 Drawing Sheets 10
60
20C
16A
58
62
64
54
52
14A
26A
22
26
26B
18A
56
30
6
6
18
20B
46
20A
50
48
32
36
28
34
18B
14
20
24A
12
24B
24
16

54
20B
14
56
7
7
52

56
54
20B
14
52

MULTIPLE TOOL ORGANIZING AND STORING CARRIER

BACKGROUND OF THE INVENTION

1. Field of the Invention

The present invention generally relates to storing and transporting multiple tools and, more particularly, is concerned with a carrier for organizing and storing multiple tools.

2. Description of the Prior Art

Mechanics and repairmen who are required to make service calls typically carry a large assortment of tools in conventional tool boxes which provide little, if any, organization of the tools. Much time is normally wasted in searching through the jumble of tools for a desired size wrench or the like. Also, there is no way to easily and quickly check to see that all of the tools have been returned to the box at the end of the service call.

One prior art tool box which has attempted to overcome these problems is disclosed in U.S. Pat. No. 4,819,800 to Wilson. This prior art tool box is of rectangular shape and formed of two identical shallow halves hinged together to have an open position for use and a closed position for carrying. The halves of the tool box have planar walls with a plurality of tool holders attached thereto for holding multiple tools, organized by type and size. Handles on the tool box permit carrying of the tool box while in the closed position to the job where it can then be opened for use.

While the tool box of the cited Wilson patent may be a step in the right direction, it does not approach an optimum solution to the aforementioned problems. As a consequence, a need still remains for more improvments in the design of tool boxes and the like.

SUMMARY OF THE INVENTION

The present invention provides a multiple tool organizing and storing carrier designed to overcome the aforementioned problems and satisfy the aforementioned need. In accordance with the present invention, the multiple tool carrier comprises: (a) a central housing having a bottom wall and upright opposite end walls, the central housing also having open opposite sides; (b) a pair of opposite side doors pivotally mounted to the central housing for pivoting between opened positions away from the opposite sides of the central housing and closed positions engaged with opposite sides of the central housing; and (c) a plurality of tool holders separately supported on the central housing and on interiors of the side doors. The central housing also has an upright partition extending between the opposite end walls. The opposite end walls preferably have substantially identical trapezoidal shapes, while the side doors preferably have substantially identical rectangular shapes.

More particularly, the opposite side doors are pivotally mounted along lower edges thereof to opposite edges of the bottom wall of the central housing for pivoting between the opened positions away from the central housing and the closed positions engaged with opposite side edges of the end walls of the central housing. Also, the carrier further comprises means for opening and closing an open top formed by the end walls of the central housing and the opposite side doors when in the closed positions. The opening and closing means is a lid hinged to an upper edge of one side door and being capable of pivotally moving relative thereto for opening away from and closing upon the open top of the carrier.

Further, the tool holders supported on the central housing include a row of hollow upright channels attached on one side of the partition for holding tools in upright positions, and a shelf attached on and projecting from an opposite side of the partition and having openings for receiving tools in order to thereby support them from the shelf. The tool holders supported on one side door include lower means attached to the interior of the one side door and defining a row of hollow upright channels for receiving lower portions of elongated tools and holding the tools upright, and upper means attached to the interior of the one side door and defining a row of spaced apart notches aligned above the channels for engaging upper portions of the elongated tools and retaining the tools in stationary positions relative to the one side door. The tool holders supported on the other side door include a pair of upper and lower shelves attached to the interior of and projecting from the other side door and having openings for receiving tools in order to thereby support them from the shelves.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
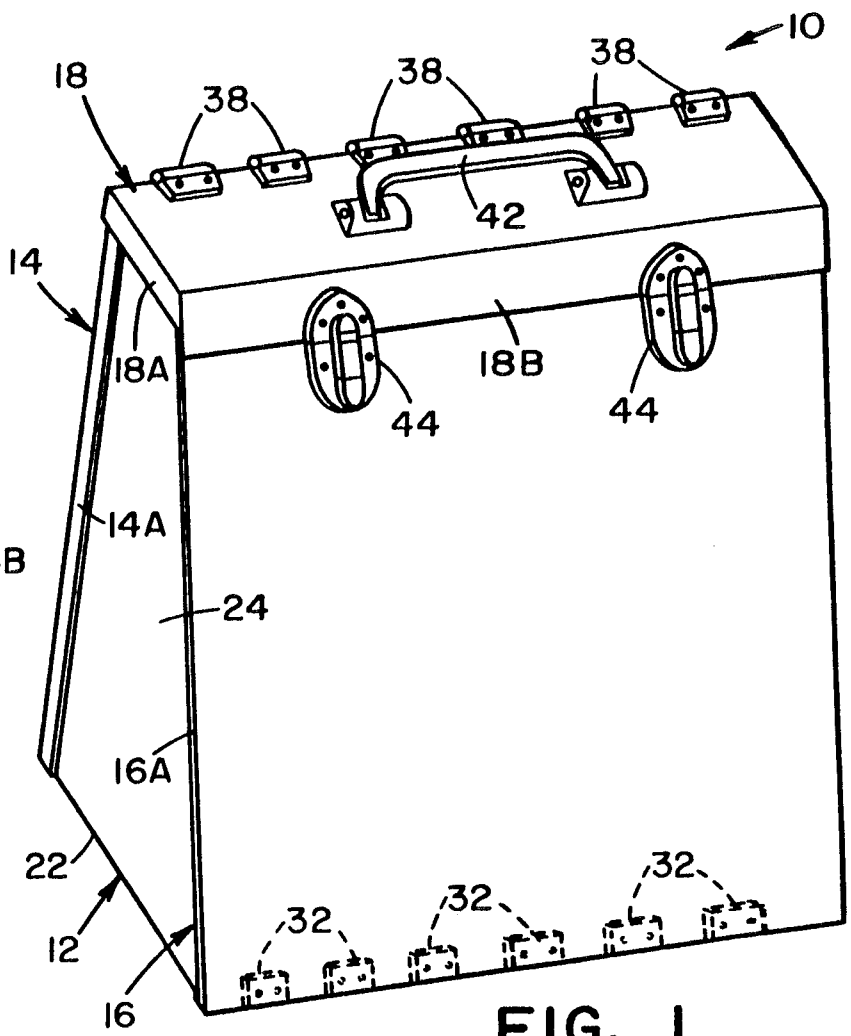
FIG. 1 is a top perspective view of a multiple tool organizing and storing carrier of the present invention being shown in a closed condition.
Figure 2:
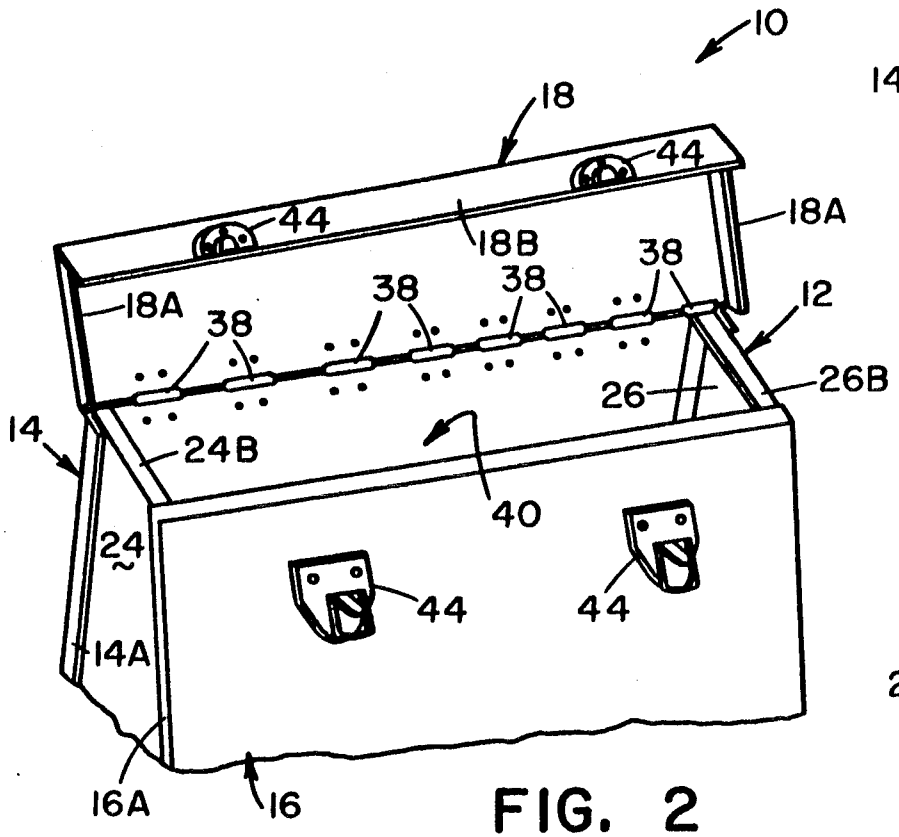
FIG. 2 is a fragmentary view of the multiple tool carrier of FIG. 1 showing a lid in an opened condition.
Figure 3:
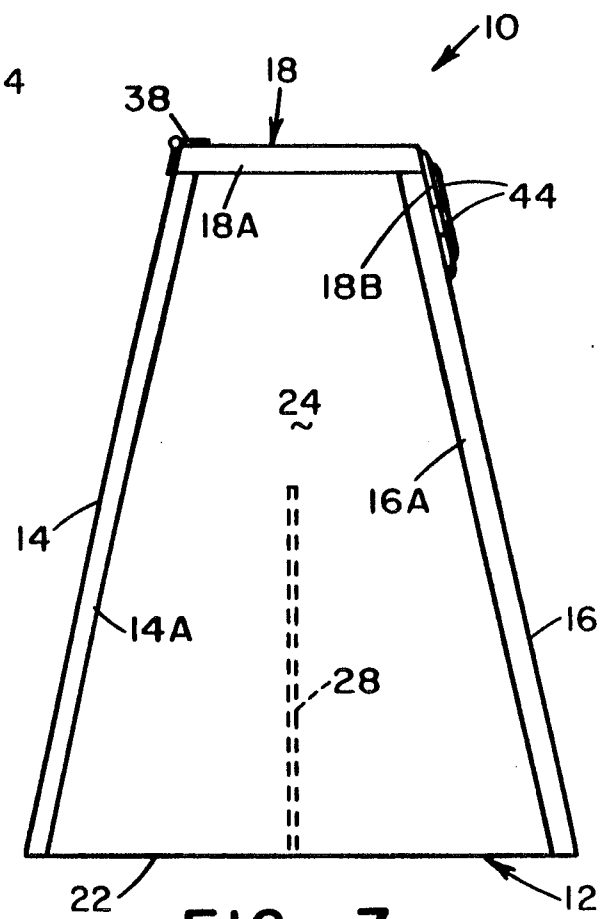
FIG. 3 is a side elevational view of the multiple tool carrier of FIG. 1 being shown in a closed condition.
Figure 4:
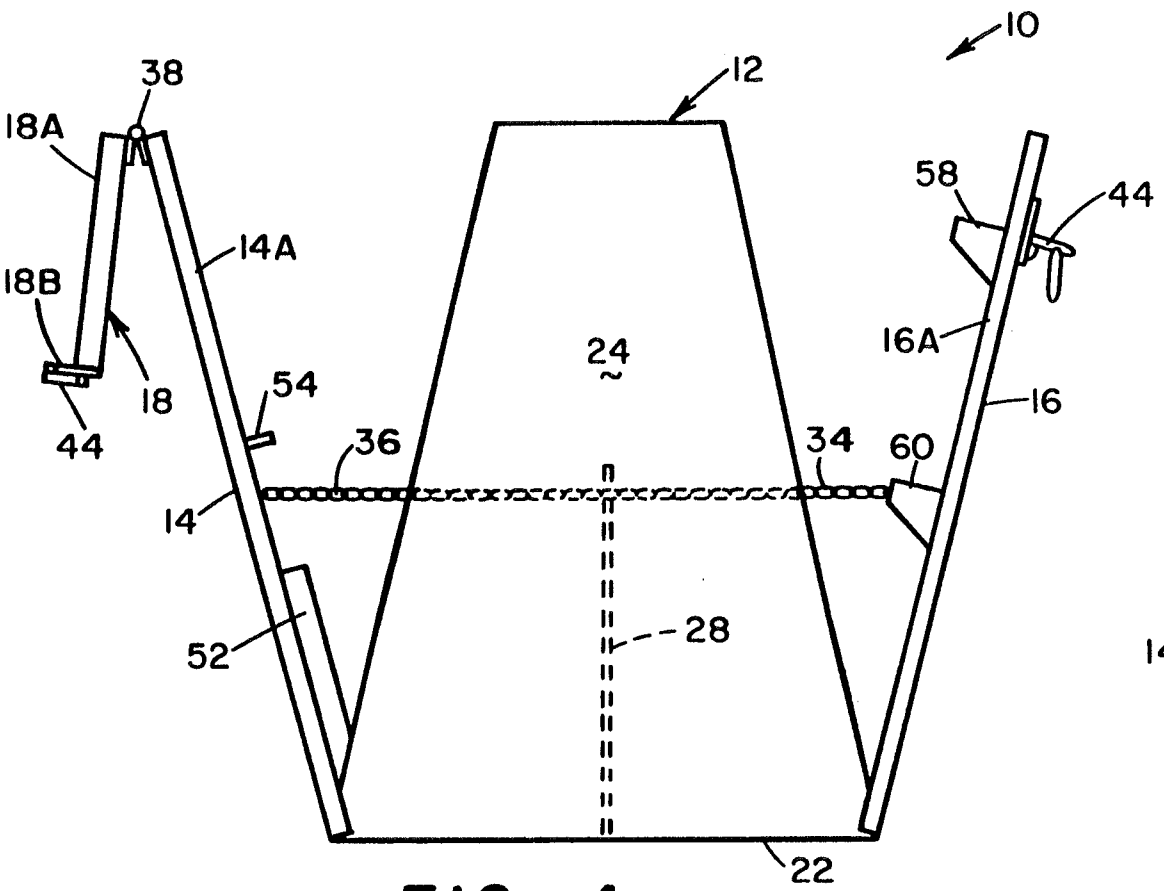
FIG. 4 is a side elevational view of the multiple tool carrier being shown in an opened condition.
Figure 5:
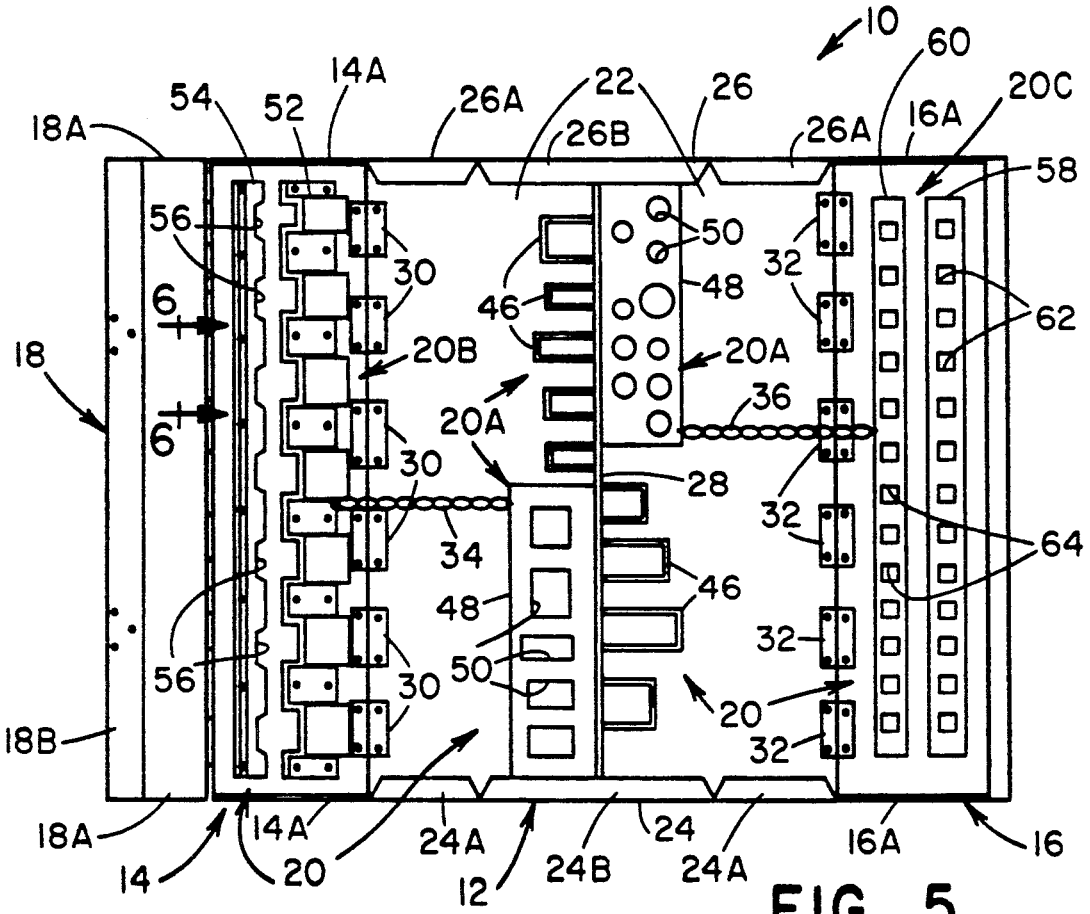
FIG. 5 is a top plan view of the multiple tool carrier as seen along line 5—5 of FIG. 4.
Figure 6:
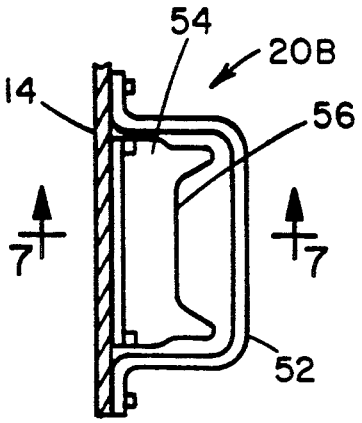
FIG. 6 is an enlarged fragmentary front elevational view of a tool rack on one of the side doors of the multiple tool carrier as seen along line 6—6 of FIG. 5.
Figure 7:
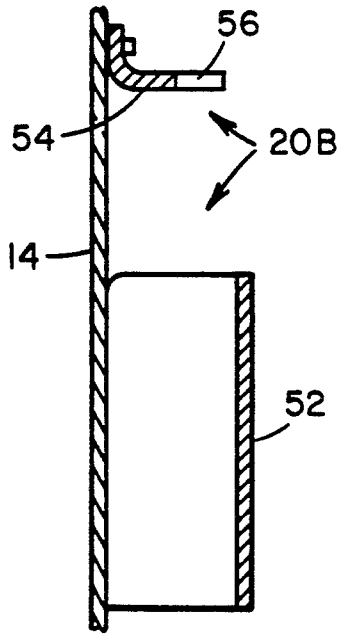
FIG. 7 is a vertical sectional view of the tool rack taken along line 7—7 of FIG. 6.

Referring to the drawings and particularly to FIGS. 1-5, there is illustrated a carrier, generally designated 10, of the present invention for organizing, storing and transporting a multiplicity of different tools. The multiple tool carrier 10 basically includes a central housing 12, a pair of opposite side doors 14, 16, a top lid 18, and a plurality of tool holders 20.

The central housing 12 of the carrier 10 includes a bottom wall 22 and a pair of upright opposite end walls 24, 26 being rigidly connected at lower edges to opposite end edges of the bottom wall 22. The central housing 12 also includes an upright partition 28 extending upwardly from the bottom wall 22 and generally along a longitudinal centerline thereof and between the upright opposite end walls 24, 26. The partition 28 is preferably disposed in generally perpendicular relation to the bottom wall 22 and opposite end walls 24, 26. Also, the partition 28 is rigidly attached at its opposite side edges and lower edge respectively to the interiors of the bottom wall 22 and opposite end walls 24, 26. The partition 28 thus functions not only as an interior wall for supporting some of the tool holders 20 as will be described below, but also for reinforcing the structure of the central housing 12 and thereby of the carrier 10 itself.

Referring to FIGS. 1-5, the pair of opposite side doors 14, 16 pivotally mounted at lower edges thereof by pluralities of hinges 30, 32 attached to and extending along respective opposite side edges of the bottom wall 22 of the central housing 12. The opposite side doors 14, 16 are thus capable being manually pivoted between closed and opened positions, as respectively shown in FIGS. 3 and 4, toward and away from open opposite sides of the central housing 12 which are defined by the bottom wall 22 and the upright opposite end walls 24, 26 thereof. Further, in their opened positions shown in FIGS. 4 and 5, the side doors 14, 16 are held in outwardly inclined relation from the central housing 12 by flexible members 34, 36 in the form of link chains. The flexible chains 34, 36 are connected to and extend between the partition 28 and the opposite side doors 14, 16. At their closed positions, the opposite side doors 14, 16 are engaged with opposite side edges of the opposite end walls 24, 26 of the central housing 12. The opposite end walls 24, 26 have inturned side flanges 24A, 26A against which the opposite side doors 14, 16 rest when at their closed positions. The opposite side doors 14, 16 have inturned side flanges 14A, 16A along their vertical side edges which overlap on the exterior of the side edges of the end walls 24, 26 when the side doors are at their closed positions.

The top lid 18 of the carrier 10 is pivotally mounted at one edge thereof by a plurality of hinges 38 attached to and extending along an upper edge of the one side door 14. The top lid 18 is thus capable being manually pivoted relative to the one side door 14 between a lower closed position and an upper opened position, as respectively shown in FIGS. 1 and 2, toward and away from a rectangular-shaped open top 40 of the carrier 10 formed by the opposite end walls 24, 26 of the central housing 12 and the opposite side doors 14, 16 when in their closed positions. The opposite end walls 24, 26 have inturned top flanges 24B, 26B upon which the top lid 18 rests when at its closed position. The top lid 18 has inturned side flanges 18A along their side edges which overlap on the exterior of the top edges of the end walls 24, 26 when the top lid 18 is at its closed position.

Furthermore, as seen in FIG. 1, the multiple tool carrier 10 has a handle 42 pivotally attached on the exterior of the top lid 18. A pair of releasable latches 44 are attached on and bridge across a front lip 18B on the top lid 18 and the upper edge portion of the other side door 32.

Referring to FIGS. 4-7, as mentioned above the multiple tool carrier 10 includes a plurality of separate tool holders 20. The tool holders 20A are supported on the central housing 12, whereas tool holders 20B and 20C are supported respectively on the interiors of the opposite side doors 14, 16 of the carrier 10. The tool holders 20A on the central housing 12 are separately supported on opposite sides of the partition 28 thereof. These tool holders 20A include rows of hollow upright channels 46 attached at diagonal locations on the opposite sides of the partition 28 which are adapted for holding tools in upright positions. These tool holders 20A also include shelves 48 attached at other diagonal locations on and projecting from the opposite sides of the partition 28. The shelves 48 have openings 50 for receiving tools in order to thereby support them from the shelves 48.

The tool holders 20B supported on one side door 14 include a lower row of hollow upright channels 52 attached to the interior of the one side door 14 for receiving lower portions of elongated tools and holding the tools upright. The tool holders 20B include an upper bracket 54 attached to the interior of the one side door 14 and defining a row of spaced apart notches 56 aligned above the channels 52 for engaging upper portions of the elongated tools and retaining the tools T (shown in phantom outline) in stationary positions relative to the one side door 14. The tool holders 20C supported on the other side door 16 include a pair of upper and lower shelves 58, 60 attached to the interior of and projecting from the other side door 16 and having respective openings 62, 64 for receiving tools in order to thereby support them from the shelves 58, 60.

Preferably, the bottom wall 22 and partition 28 have rectangular shapes. The upright opposite end walls 24, 26 have substantially identical trapezoidal shapes. The opposite side doors 14, 16 have substantially identical rectangular shapes. The top lid 18 has a rectangular shape. The central housing 12, side doors 14, 16 and lid 18 can be made from conventional materials, such as aluminum sheet metal.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A multiple tool organizing and storing carrier, comprising:

(a) a central housing having a bottom wall and upright opposite end walls, said central housing also having open opposite sides;

(b) a pair of opposite side doors pivotally mounted to said central housing for pivoting between opened positions away from said opposite sides of said central housing and closed positions engaged with opposite sides of said central housing;

(c) a plurality of tool holders separately supported on said central housing and on interiors of said side doors; and (d) means for opening and closing an open top formed by said end walls of said central housing and said opposite side doors when in said closed positions, said opening and closing means being a lid hinged to an upper edge of one of said side doors, said lid being capable of pivotally moving relative to said one side door for opening away from and closing upon said open top of said carrier.

2. The carrier of claim 1 wherein said opposite end walls have substantially identical trapezoidal shapes.

3. The carrier of claim 1 wherein said side doors have substantially identical rectangular shapes.

4. The carrier of claim 1 wherein said central housing also has an upright partition extending between the opposite end walls.

5. The carrier of claim 4 wherein said tool holders being supported on said central housing are supported on opposite sides of said upright partition.

6. The carrier of claim 5 wherein said tool holders supported on said partition include:

a row of hollow upright channels of different cross-sectional sizes attached on one opposite side of said partition for holding different tools in upright positions; and a shelf attached on and projecting from the other opposite side of said partition and having openings for receiving different tools in order to thereby support the tools from said shelf.

7. The carrier of claim 1 wherein said tool holders supported on one of said side doors include:

lower means attached on the interior of said one side door and defining a row of hollow upright channels for receiving lower portions of elongated tools and holding the tools upright; and upper means attached on the interior of said one side door and defining a row of spaced apart notches aligned above said channels for engaging upper portions of the elongated tools and retaining the tools in stationary positions relative to said on side door.

8. The carrier of claim 1 wherein said opposite side doors are pivotally mounted along lower edges thereof to opposite edges of said bottom wall of said central housing for pivoting between said opened positions away from said central housing and said closed positions engaged with opposite side edges of said end walls of said central housing.

9. A multiple tool organizing and storing carrier, comprising:

(a) a central housing having a bottom wall and upright opposite end walls and an upright partition extending between said opposite end walls;

(b) a pair of opposite side doors pivotally mounted along lower edges thereof to opposite edges of said bottom wall of said central housing for pivoting between opened positions away from said central housing and closed positions engaged with opposite side edges of said end walls of said central housing;

(c) means for opening and closing an open top formed by said end walls of said central housing and said opposite side doors when in said closed positions, said opening and closing means being a lid hinged to an upper edge of one of said side doors, said lid being capable of pivotally moving relative to said one side door for opening away from and closing upon said open top of said carrier; and (d) a plurality of tool holders separately supported on opposite sides of said partition and on interiors of said side doors.

10. The carrier of claim 9 wherein said opposite end walls have substantially identical trapezoidal shapes.

11. The carrier of claim 9 wherein said side doors have substantially identical rectangular shapes.

12. The carrier of claim 9 wherein said tool holders supported on said partition include:

a row of hollow upright channels of different cross-sectional sizes attached on one opposite side of said partition for holding different tools in upright positions; and a shelf attached on and projecting from the other opposite side of said partition and having openings for receiving different tools in order to thereby support the tools from said shelf.

13. The carrier of claim 9 wherein said tool holder on one of said side doors include:

lower means attached on the interior of said one side door and defining a row of hollow upright channels for receiving lower portions of elongated tools and holding the tools upright; and upper means attached on the interior of said one side door and defining a row of spaced apart notches aligned above said channels for engaging upper portions of the elongated tools and retaining the tools in stationary positions relative to said one side door.

14. A multiple tool organizing and storing carrier, comprising:

(a) a central housing having a rectangular-shaped bottom wall and upright trapezoidal-shaped opposite end walls and an upright rectangular-shaped partition extending between said opposite end walls;

(b) a pair of opposite rectangular-shaped side doors pivotally mounted along lower edges thereof to opposite edges of said bottom wall of said central housing, said side doors being capable of pivoting between opened positions away from said central housing and closed positions engaged with opposite side edges of said end walls of said central housing;

(c) a rectangular-shaped lid hinged to an upper edge of one of said side doors and being capable of pivotally moving relative to said side door for opening away from and closing upon a rectangular-shaped open top of said carrier formed by said end walls of said central housing and said side doors when in said closed positions; and (d) a plurality of tool holders being separately supported on opposite sides of said partition of said central housing and on interiors of said side doors.

15. The carrier of claim 14 wherein said tool holders supported on said partition include:

a row of hollow upright channels of different cross-sectional sizes attached on one opposite side of said partition for holding different tools in upright positions; and a shelf attached on and projecting from the other opposite side of said partition and having openings for receiving different tools in order to thereby support the tools from said shelf.

16. The carrier of claim 14 wherein said tool holders supported on one of said side doors include:

lower means attached on the interior of said one side door and defining a row of hollow upright channels for receiving lower portions of elongated tools and holding the tools upright; and upper means attached on the interior of said one side door and defining a row of spaced apart notches aligned above said channels for engaging upper portions of the elongated tools and retaining the tools in stationary positions relative to said one side door.

17. The carrier of claim 16 wherein said tool holders supported on the other of said side doors include a pair of upper and lower shelves attached on and projecting from the interior of said other side door and having openings for receiving different tools in order to thereby support the tools from said shelves.

* * * * *